US010696920B2

(12) United States Patent
Toukonitty et al.

(10) Patent No.: US 10,696,920 B2
(45) Date of Patent: Jun. 30, 2020

(54) WATER TREATMENT OF LIPID MATERIAL

(71) Applicant: Neste Oyj, Espoo (FI)

(72) Inventors: Blanka Toukonitty, Espoo (FI); Petri Lindqvist, Espoo (FI)

(73) Assignee: NESTE OYJ, Espoo (FI)

( * ) Notice: Subject to any disclaimer, the term of this patent is extended or adjusted under 35 U.S.C. 154(b) by 0 days.

(21) Appl. No.: 16/337,717

(22) PCT Filed: Sep. 28, 2017

(86) PCT No.: PCT/EP2017/074583
§ 371 (c)(1),
(2) Date: Mar. 28, 2019

(87) PCT Pub. No.: WO2018/060305
PCT Pub. Date: Apr. 5, 2018

(65) Prior Publication Data

US 2020/0040277 A1 Feb. 6, 2020

(30) Foreign Application Priority Data

Sep. 30, 2016 (FI) ..... 20165733

(51) Int. Cl.
*C11B 3/00* (2006.01)
*C11B 3/16* (2006.01)

(52) U.S. Cl.
CPC ..... *C11B 3/001* (2013.01); *C11B 3/008* (2013.01); *C11B 3/16* (2013.01)

(58) Field of Classification Search
CPC ..... C11B 3/001; C11B 3/008; C11B 3/16
USPC ..... 554/175
See application file for complete search history.

(56) References Cited

U.S. PATENT DOCUMENTS

| | | | |
|---|---|---|---|
| 2,182,755 | A | 12/1939 | Benjamin et al. |
| 2,601,375 | A | 6/1952 | Durkee |
| 2,657,224 | A | 10/1953 | Bierke |
| 2,728,714 | A | 12/1955 | Winkler et al. |
| 3,758,533 | A | 9/1973 | Lee |
| 3,984,447 | A | 10/1976 | Cooper et al. |
| 4,033,859 | A | 7/1977 | Davidson et al. |
| 4,865,978 | A | 9/1989 | Serota |
| 5,306,419 | A | 4/1994 | Harrison et al. |
| 5,676,840 | A | 10/1997 | Paul |
| 7,262,311 | B2 | 8/2007 | Christianson et al. |
| 2009/0266743 | A1 | 10/2009 | Yao et al. |

(Continued)

FOREIGN PATENT DOCUMENTS

| | | | |
|---|---|---|---|
| CN | 103224836 | A | 7/2013 |
| CN | 104479863 | A | 4/2015 |

(Continued)

OTHER PUBLICATIONS

International Preliminary Report on Patentability (PCT/IPEA/409) dated Jan. 30, 2019, by the European Patent Office as the International Searching Authority for International Application No. PCT/EP2017/074583.

(Continued)

*Primary Examiner* — Deborah D Carr
(74) *Attorney, Agent, or Firm* — Buchanan Ingersoll & Rooney PC

(57) ABSTRACT

Present invention relates to a novel process for purification of lipid material for further use as such as e.g. a source of fuel or chemicals.

16 Claims, 1 Drawing Sheet

(56) References Cited

U.S. PATENT DOCUMENTS

| | | | |
|---|---|---|---|
| 2011/0047866 | A1 | 3/2011 | Bao et al. |
| 2011/0077436 | A1 | 3/2011 | Yao et al. |
| 2011/0184201 | A1 | 7/2011 | Mcneff |
| 2013/0345457 | A1 | 12/2013 | Mcneff |
| 2014/0087042 | A1 | 3/2014 | Gordon et al. |
| 2016/0060565 | A1 | 3/2016 | Perez et al. |

FOREIGN PATENT DOCUMENTS

| | | | | |
|---|---|---|---|---|
| DE | 102011055559 | A1 * | 5/2013 | ..... C11B 3/10 |
| DE | 102011055559 | A1 | 5/2013 | |
| EP | 0195991 | A2 | 10/1986 | |
| FI | 96964 | C | 9/1996 | |
| GB | 1065051 | A | 4/1967 | |
| GB | 1470022 | A | 4/1977 | |
| GB | 1510056 | A | 5/1978 | |
| GB | 2412664 | A | 10/2005 | |
| NL | 7205618 | A | 10/1973 | |
| WO | 2010010364 | A2 | 1/2010 | |
| WO | 2013006578 | A1 | 1/2013 | |
| WO | 2014058294 | A1 | 4/2014 | |
| WO | 2014081279 | A1 | 5/2014 | |

OTHER PUBLICATIONS

International Search Report (PCT/ISA/210) dated Feb. 5, 2018, by the European Patent Office as the International Searching Authority for International Application No. PCT/EP2017/074583.

Written Opinion (PCT/ISA/237) dated Feb. 5, 2018, by the European Patent Office as the International Searching Authority for International Application No. PCT/EP2017/074583.

Written Opinion of the International Preliminary Examining Authority (PCT/IPEA/408) dated Aug. 20, 2018, by the European Patent Office as the International Searching Authority for International Application No. PCT/EP2017/074583.

International Preliminary Report on Patentability (PCT/IPEA/416) dated Jan. 3, 2019, issued in corresponding International Patent Application No. PCT/EP2017/074578. (6 pages).

International Search Report and Written Opinion dated Dec. 1, 2017, issued in corresponding International Patent Application No. PCT/EP2017/074578. (9 pages).

D. Rade, et al., "Effect of Soybean Pretreatment on the Phospholipid Content in Crude and Degummed Oils," FETT—Lipid.Fat Science Technology, Wiley-VCH Verlag, Weinheim, DE, vol. 97, Jan. 1, 1995, pp. 501-507.

Search Report issued in corresponding Finnish Patent Application No. 20165734, dated Jan. 30, 2017. (2 pages).

Finnish Search Report for Finnish Patent Application No. 20165735 dated Jan. 30, 2017. (2 pages).

International Preliminary Report on Patentability (PCT/IPEA/409) dated Sep. 19, 2018, by the European Patent Office as the International Searching Authority for International Application No. PCT/EP2017/074611. (11 pages).

International Search Report (PCT/ISA/210) dated Jan. 2, 2018, by the European Patent Office as the International Searching Authority for International Application No. PCT/EP2017/074611. (3 pages).

Written Opinion (PCT/ISA/237) dated Jan. 2, 2018, by the European Patent Office as the International Searching Authority for International Application No. PCT/EP2017/074611. (8 pages).

U.S. Appl. No. 16/337,726, "Oil Purification Process" by Annika Malm, et al., filed Mar. 28, 2019.

U.S. Appl. No. 16/337,744, "Method for Purification of Animal or Vegetable Fats" by Pia Bergström, et al., filed Mar. 28, 2019.

* cited by examiner

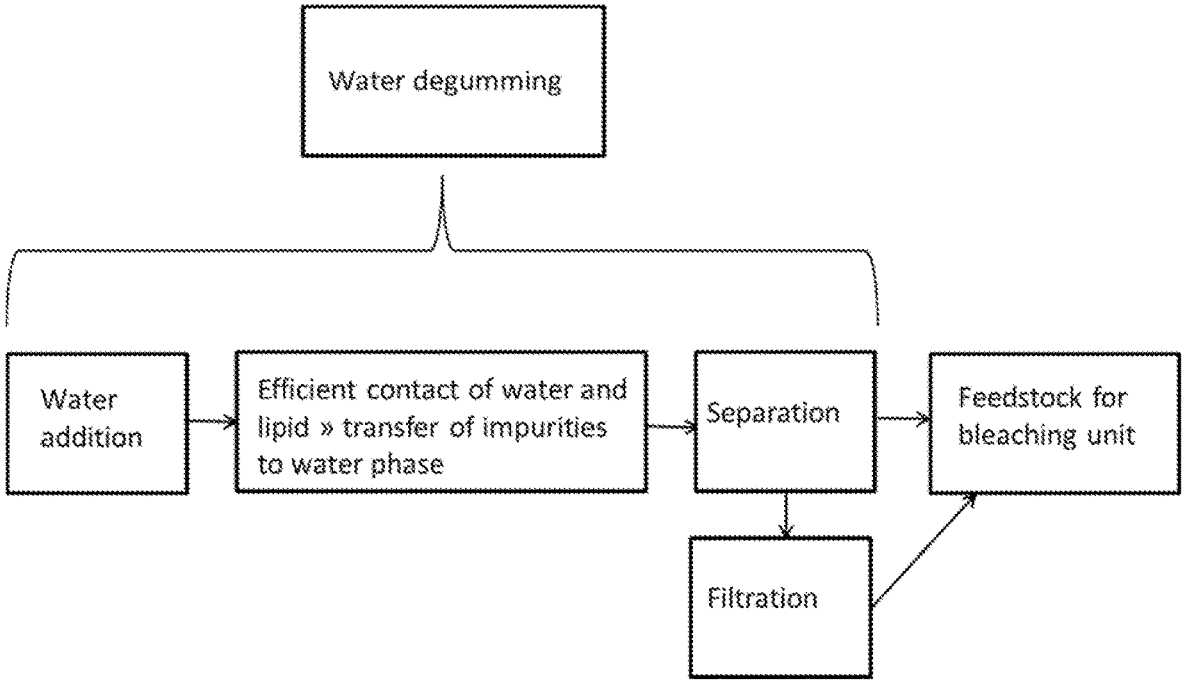
Water degumming
Water addition
Efficient contact of water and lipid » transfer of impurities to water phase
Separation
Feedstock for bleaching unit
Filtration

WATER TREATMENT OF LIPID MATERIAL

TECHNICAL FIELD

Present invention relates to methods for purification of liquid animal fats (AF). The method enables removal of i.a. polyethylene or other plastics. In particular, the invention relates to methods for purifying animal fat that is conventionally seen as containing levels of impurities too high to be commercially profitable to use in a purification process to obtain a purified feedstock of a quality allowing the use thereof as a source of fuel or chemicals. The impurities may be of a character that conventional methods are not able to remove from the feedstock to such a degree that is prescribed as the appropriate quality for further use as a source of fuel or chemicals.

BACKGROUND ART

WO 2010/037772 relates to the problem with polyethylene and other polymers in especially animal fats. The examples in WO 2010/037772 relates to animal fats containing up to 500 ppm PE (polyethylene). However, the purification method for removal of PE (and other insolubles) from the oil is bleaching in combination with filtration.

SUMMARY OF THE INVENTION

Present invention provides for an efficient method of purification of i.a. animal fats (AF). Consequently, present invention relates to a process for purification of lipid material originating from such as e.g. animal sources, the process comprising the steps of:

a) heating the lipid material b) adding water to the lipid material c) allowing efficient contact of water and lipids to enable impurities to transfer to water phase d) separating the lipid material from step c) by centrifugation, settling, decanting or evaporating e) optionally subjecting the separated lipid material from step d) to a filtration step to remove solid impurities f) optionally subjecting the lipid material from step d) or filtrate from step e) to a post treatment to thereby remove impurities in the lipid material.

Moreover, the invention relates to a method for removal of polymers, such as e.g. polyethylene (PE) from a lipid material such as e.g. animal fats (AF).

In present invention the term "lipid material" or fat(s) should be understood as meaning any animal based oils or fats, such as e.g. fish based oils or fats, suet, tallow, blubber, recycled alimentary fats etc. It is to be understood that the term may comprise a mixture of any of the above mentioned examples. However, in other embodiments the term "lipid material" may comprise any type of lipid or fat. For example, the term may comprise a lipid material/oil of plant, microbial and/or animal origin. Non-limiting examples are one or more of tall oil or the residual bottom fraction from tall oil distillation processes, vegetable or plant based oil or fat such as e.g. sludge palm oil or used cooking oil, microbial or algae oils, free fatty acids, or any lipids containing phosphorous and/or metals, oils originating from yeast or mould products, oils originating from biomass, rapeseed oil, canola oil, colza oil, tall oil, sunflower oil, soybean oil, hemp oil, olive oil, linseed oil, cottonseed oil, mustard oil, palm oil, arachis oil, castor oil, coconut oil, starting materials produced by genetic engineering, and biological starting materials produced by microbes such as algae and bacteria or any mixtures of said lipid materials.

The lipid material used in the process may also be fossil based, such as e.g. various oils used and produced by the oil industry. Non-limiting examples are various petroleum products such as e.g. fuel oils and gasoline (petrol). The term also encompasses all used products in either the refining process or e.g. used lubrication oils.

The impurities present in the lipid material may be of various character or origin. Specifically, the impurities are such that they may be harmful in the process, e.g. they may poison or deactivate catalysts used in any further processing of the lipid material following the process of present invention. The impurities may be of metallic or polymeric origin such as elementary metals or for example phosphorous compounds. Specifically, the polymeric impurities that are removed may be e.g. commonly used plastics such a polyethylene (PE).

Consequently, the invention also relates to use of a purified lipid material obtainable by the method according to present invention, as a source of fuel, bulk chemicals such as e.g. polymers, solvents, lubricants, or specialty chemicals such as e.g. cosmetics, pharmaceuticals etc.

Thus, the method according to the invention provides for a purified lipid material that fulfils the requirements for bulk chemicals or specialty chemicals such that the necessary purity requirements for such chemicals are met.

Notably, it has surprisingly been found that the method as described herein is effective with respect to the desired result as well as omitting addition of substances or processes commonly seen in the art.

Moreover, the process takes place by heating a mixture of water and lipid material. However, the process does not include any addition of an acid to the water when used in steps a)-c) according to the invention.

BRIEF DESCRIPTION OF THE DRAWINGS

FIG. 1. illustrates a schematic outline of the method according to the invention, wherein the water pre-treatment is outlined with parenthesis.

DETAILED DESCRIPTION

Present invention relates to a method for purifying a lipid material. Moreover, the invention relates to a method for removal, wholly or partly, of any polymeric material, from a lipid material. Throughout present description, it is to be understood that the terms "water pre-treatment" and "water degumming" are used interchangeably and for the purpose of present invention have the same meaning.

Specifically, the invention relates to a process for purifying animal fats (AF), the method comprising the steps of;

a) heating the lipid material b) adding water to the lipid material c) allowing efficient contact of water and lipids to enable impurities to transfer to water phase d) separating water phase and/or solids from the lipid material from step c) by centrifugation, settling, decanting or evaporating.

Moreover, the method may further comprise e) optionally subjecting the separated lipid material from step d) to a filtration step to remove solid impurities.

The filtration step according to the above may be performed e.g. if water is evaporated first when the solid impurities remain in the lipid material.

Additionally, the method according to the invention may further comprise f) optionally subjecting the lipid material from step d) or filtrate from step e) to a post treatment.

In one aspect, the invention relates to a process for removal of plastics from a lipid material, the process comprising the steps of:

a) heating the lipid material b) adding water to the lipid material c) allowing efficient contact of water and lipids to enable impurities to transfer to water phase d) separating the lipid material from step c) by centrifugation, settling, decanting or evaporating e) optionally subjecting the separated lipid material from step d) to a filtration step to remove solid impurities f) optionally subjecting the lipid material from step d) or filtrate from step e) to a post treatment to thereby remove plastics in the lipid material.

The post treatment step may comprise one or more subsequent steps that may comprise one or more different post treatment techniques in any order. Consequently, the post treatment step may comprise e.g. bleaching or other degumming techniques or filtration or separation steps which may in turn be combined in any order with one another. With respect to filtration, any filtration technique known in the art can be used. Separation may include any suitable separation technique such as e.g. centrifugation or phase separation. With respect to centrifugation, such operation may be performed during anytime that is deemed suitable, such as e.g. during a period of about 1 minutes to about 30 minutes, such as e.g. about 5 minutes to about 30 minutes or about 10 minutes etc.

Moreover, the temperature at which filtration or centrifugation takes place may be in any suitable range, such as e.g. about 50° C. to about 250° C., such as e.g. 60° C. to about 240° C., such as e.g. 70° C. to about 230° C., such as e.g. 80° C. to about 220° C., or about 60° C., about 80° C., about 130° C., or about 220° C.

Specifically, the temperature during filtration or centrifugation may be about 60° C., or about 80° C.

The lipid material to be used in present invention is a lipid material to be purified into a material that may serve as a source for fuel of any kind or as a source of chemicals such as e.g. specialty chemicals. The important factor is that the purified lipid material has to be of such a quality that it can serve as a fuel or be used in further processes such as e.g. catalytic cracking without containing levels of impurities that may e.g. jeopardize the full functionality of an engine or poisoning of catalysts or otherwise hampering of any further processes that the purified feedstock may be subjected to. Such further processes may be e.g. catalytic cracking, thermo-catalytic cracking, catalytic hydrotreatment, fluid catalytic cracking, catalytic ketonization, catalytic esterification, or catalytic dehydration. The purified feedstock may also be further processed into various chemicals, such as bulk chemicals (e.g. polymers, solvents, solvent components and lubricants) or specialty chemicals (e.g. cosmetics and pharmaceuticals).

In the art, there are various methods for purification of lipid material for the purposes mentioned herein. However, lipid material that contains high level of impurities may not be able or feasible to be purified by techniques known in the art such that the purified lipid material contains low levels of impurities allowing it to be used as a source of fuel. Present invention solves this problem by the method as disclosed herein, thereby allowing use of a lipid material that would normally be seen as uneconomical or unsuitable for purification.

Lipid material according to the invention may be, but is not limited to, any lipids containing phosphorous and/or metals and/or polymers such as e.g. various plastics. Examples of lipid materials any animal based oils or fats, such as e.g. suet, tallow or blubber. It is to be understood that lipid material may be a mixture of any of the above mentioned examples of lipid material.

Exemplified lipid material include, but is not limited to, low quality animal fat (AF), not accepted to catalytic hydrotreatment process (very high content of nitrogen or nitrogen containing compounds, PE, metals, phosphorus contents etc.).

Such lipid material needs to be purified in order to lower the level of elements known to e.g. act as catalyst poison or otherwise render the material useless for its ultimate intended use.

The lipid material to be purified may contain impurities containing metals and phosphorus in the form of phospholipids, soaps or salts. Moreover, the lipid material may contain polymers and specifically polymers in the context of plastics. Notably such plastics may be e.g. polyethylene (PE). However, any plastic polymer may be removed according to the invention. Exemplary plastics may Bakelite, polystyrene, polyvinyl chloride, poly(methyl methacrylate), rubber or synthetic rubber, polyester, polyethylene terephthalate, high-density polyethylene, polyvinylidene chloride, low-density polyethylene, polypropylene, high impact polystyrene, polyamides, acrylonitrile butadiene styrene, polyethylene/acrylonitrile butadiene styrene, polycarbonate, polycarbonate/acrylonitrile butadiene styrene, polyeurethanes. It is also to be understood that the term polymer may comprise a blend of different plastics and/or rubbers.

Moreover, the method may be used to remove other impurities such as e.g. metals and nitrogen or nitrogen containing compounds. The nitrogen containing compounds may be simple amines or nitrates, nitrites or ammonium salts of any kind.

Metal impurities that may be present in the lipid material may be e.g. alkali metals or alkali earth metals, such as sodium or potassium salts or magnesium or calcium salts or any compounds of said metals. The impurities may also be in form of phosphates or sulphates, iron salts or organic salts, soaps or e.g. phospholipids.

According to the invention, the process of purification takes place under heating. Specifically, according to the invention, the elevated temperature in step a)-c) is such that the temperature is sufficiently high to allow the lipid material to be purified to become liquid. Thus, the lipid material is heated to about 40° C. to about 200° C., such as e.g. about 40° C. to about 120° C., such as e.g. about 50° C. to about 110° C., such as e.g. about 60° C., about 100° C., or about 40° C., about 50° C., about 60° C., about 70° C., about 80° C., about 90° C., about 100° C., about 110° C. or about 120° C. Preferably, the temperature range is about 50° C. to about 120° C.

The heating of the lipid material is maintained as long as the lipid material stays liquid. The time during which the lipid material is heated and held at the desired temperature is about 1 day to about 7 days, such as e.g. about 2 days, such as e.g. about 3 days etc. However, the mixing time may be any time suitable to allow for an efficient contact between the water and the lipid material. Such time depends on the type of mixing. For example, high shear mixing typically requires shorter times than slow mixing methods. Mixing time may thus be e.g. 0.1 s or about 2 seconds, or about 1 minute, about 20 minutes, about 30 minutes, about 40 minutes, about 60 minutes, or about 2 hours, about 4 hours, about 6 hours, about 8 hours, about 12 hours etc.

Water is added to the heated oil in step b) of the invention. Typical amounts of water added is about 0.1% to about 5% (wt %). Water may be added in any suitable fashion, notably so to avoid any explosive evolution of steam. This may mean that water is added in a slow fashion. Slow addition of water is only necessary when temperature of the lipid material exceeds 100° C. After addition of the water, any means allowing for an efficient contact between the water and the lipid material is employed. Thus in step c) according to the invention, vigorous mixing, slow mixing, counter current flow, dynamic cavitation or acoustic irradiation or any combination thereof may be employed.

After mixing water with the lipid material, the water is separated from the lipid material. This may take place by allowing the lipid material to separate spontaneously from the lipid material by stopping any form of mixing function and thereafter separate the lipid material from the water by decantation. However, other techniques for phase separation may be employed such as e.g. centrifugation, settling, or evaporating. Furthermore, a combination of the mentioned separation techniques may also be employed in any order as seen suitable. For example, if water is evaporated from the lipid material, the solid impurities remaining in the lipid material thereafter may be removed by e.g. filtration.

Optionally, the method according to the invention may also comprise a filtration step of the separated lipid material from step d) according to the invention. It has been surprisingly found that the water degumming/water pre-treatment of the lipid material greatly improves the filterability of the lipid material compared to acid degumming. This has the advantage that change of filters need to be undertaken with less frequently which in turn affects the economy of the process favourably. Another important effect of this is also that the process needs to be stopped less frequently for change of filters.

Furthermore, the method according to the invention may optionally further comprise subjecting the lipid material from step d) or filtrate from step e) to a bleaching unit to remove any additional impurities which may be a part of the post treatment according to the method. However, it should be noted that the polymers such as e.g. plastics of some sort present in the non-purified lipid material is removed during water degumming/water pre-treatment in steps a)-d) of the invention. Thus, a post treatment method may not be necessary if the purity of the obtained lipid material is satisfactory depending on the specification thereof.

The lipid material may be further processed by any suitable method to remove the remaining impurities from the lipid material, should such impurities be present. In the process according to the invention, most of or the entirety of the plastics present in the non-purified lipid material is removed, such as e.g. at least about 20%, or at least about 30%, at least about 40%, at least about 50%, at least about 60%, at least about 70%, at least about 80%, at least about 90%, at least about 95%, at least about 98%, at least about 99%, or 100% of the plastics present in the lipid material to be purified. The plastic or polymeric material to be removed may be e.g. polyethylene or a combination thereof with other types of plastics or polymers as listed herein.

With respect to the purified lipid material, the remaining plastics, such as e.g. polyethylene, is below about 500 ppm, such as e.g. below about 400 ppm, such as e.g. below about 300 ppm, such as e.g. below about 200 ppm, such as e.g. below about 100 ppm, such as e.g. about 50 ppm, such as e.g. below about 30 ppm, such as e.g. below about 20 ppm, such as e.g. below about 15 ppm, such as e.g. below about 10 ppm, such as e.g. below about 5 ppm.

Thus the method according to the invention provides for a purified lipid material that is suitable for further use such as e.g. a source of fuel or chemicals, such as bulk chemicals or specialty chemicals.

In one aspect, the invention also relates to the following items:

1. A process for purification of a lipid material, the process comprising the steps of:

a) heating the lipid material b) adding water to the lipid material c) allowing efficient contact of water and lipids to enable impurities to transfer to water phase d) separating the lipid material from step c) by centrifugation, settling, decanting or evaporating e) optionally subjecting the separated lipid material from step d) to a filtration step to remove solid impurities f) optionally subjecting the lipid material from step d) or filtrate from step e) to a post treatment to thereby remove impurities in the lipid material.

2. The process according to item 1, wherein the lipid material is selected from fats or oils of animal origin such as e.g. fish based oils or fats, suet, tallow, blubber, recycled alimentary fats etc., or a lipid material/oil of plant, microbial such as e.g. one or more of tall oil or the residual bottom fraction from tall oil distillation processes, vegetable or plant based oil or fat such as e.g. sludge palm oil or used cooking oil, microbial or algae oils, free fatty acids, oils originating from yeast or mould products, oils originating from biomass, rapeseed oil, canola oil, colza oil, tall oil, sunflower oil, soybean oil, hemp oil, olive oil, linseed oil, cottonseed oil, mustard oil, palm oil, arachis oil, castor oil, coconut oil, starting materials produced by genetic engineering, and biological starting materials produced by microbes such as algae and bacteria or any mixtures of said feedstocks, or a lipid material used in the process may also be fossil based, such as e.g. various oils used and produced by the oil industry.

3. The process according to any of the preceding items wherein the lipid material is of any type of animal origin such as fats or oils or any mixtures thereof and selected from e.g. fish based oils or fats, suet, tallow, blubber, recycled alimentary fats etc.

4. The process according to any of the preceding items, wherein the lipid material is heated to a temperature of about 40° C. to about 170° C. to about 40° C. to about 200° C., such as e.g. about 40° C. to about 120° C., such as e.g. about 50° C. to about 110° C., such as e.g. about 60° C., about 100° C., or about 40° C., about 50° C., about 60° C., about 70° C., about 80° C., about 90° C., about 100° C., about 110° C. or about 120° C.

5. The process according to any of the preceding items, wherein step c) is performed by vigorous mixing, slow mixing, counter current flow, dynamic cavitation or acoustic irradiation.

6. The process according to any of the preceding items, wherein the process does not include a bleaching step.

7. The process according to any of the preceding items, wherein the added water in step b) does not comprise an acid.

8. The process according to any of the preceding items, wherein the impurities removed from the lipid material is e.g. polymers, phosphorous, metals and nitrogen.

9. The process according to any of the preceding items, wherein the polymer is e.g. polyethylene, Bakelite, polystyrene, polyvinyl chloride, poly(methyl methacrylate), rubber or synthetic rubber, polyester, polyethylene terephthalate, high-density polyethylene, polyvinylidene chloride, low-density polyethylene, polypropylene, high impact polystyrene, polyamides, acrylonitrile butadiene styrene, polyethylene/acrylonitrile butadiene styrene, polycarbonate, polycarbonate/acrylonitrile butadiene styrene, polyeurethanes, or any mixtures thereof.

10. The process according to any of the preceding items, wherein the polymer is polyethylene.

11. The process according to any of the preceding items wherein up to 100%, original content of polyethylene in the lipid material is removed, such as e.g. at least about 20%, or at least about 30%, at least about 40%, at least about 50%, at least about 60%, at least about 70%, at least about 80%, at least about 90%, at least about 95%, at least about 98%, at least about 99% of polyethylene is removed.

12. A purified lipid material obtainable by the method according to any of the preceding items, characterized in that the purified lipid material has a polyethylene content of below about 500 ppm, such as e.g. below about 400 ppm, such as e.g. below about 300 ppm, such as e.g. below about 200 ppm, such as e.g. below about 100 ppm, such as e.g. about 50 ppm, such as e.g. below about 30 ppm, such as e.g. below about 20 ppm, such as e.g. below about 15 ppm, such as e.g. below about 10 ppm, such as e.g. below about 5 ppm.

13. Use of a purified lipid material obtainable by the method according to any of the preceding items, as a source of fuel, bulk chemicals such as e.g. polymers, solvents, lubricants, specialty chemicals, such as e.g. cosmetics, pharmaceuticals.

The invention is further illustrated by the below seen non-limiting examples.

EXAMPLES

Water degumming test were carried using 3 wt.-% water addition and temperature 60° C. After water addition high shear mixing was applied for 2 min and then slow mixing for 60 min. Impurities and water were separated by centrifugation. Small sample was still filtered over 0.4 μm paper to check whether all chelated impurities were separated during centrifugation tests. As mentioned previously in the description, it is to be noted that the terms "water degumming" and "water pre-treatment" are used interchangeably and have the same meaning.

Acid degumming test were carried out using 1500 ppm of citric acid, 3 wt.-% water addition and temperature 60° C. After acid addition high shear mixing was applied for 2 min after that 3 wt.-% water was added and high shear mixing was again applied for 2 min and then slow mixing for 60 min. Impurities and water were separated by centrifuge. Small sample was still filtered over 0.4 μm paper to check whether all chelated impurities were separated during centrifugation tests.

Basic bleaching tests were carried out using 1500 ppm citric acid (CA) and 0.2 wt.-% water additions. After acid+water addition, oil/acid/water mixture was stirred for 2 min by a high shear mixer and then followed by slow mixing for 5 min. Then 1.0 wt.-% of bleaching earth was added to the mixture and wet (80° C., 800 mbar, 30 min)+dry (105° C., 80 mbar, 25 min) bleaching were executed. Treated oil+body-feed were filtered over the pre-coat (bleaching earth, 0.2 wt.-%) at 105° C. in Dahlman filtration system with constant pressure of 2.5 bars over the filter cake.

Example 1

PE (Polyethylene) Removal by Water Degumming+Filtration

PE removal by water degumming+filtration can be seen from Table I and II.

As can be seen from Table I., PE (252 ppm) can be fully removed from AF (animal fat) by water degumming and filtration. Such efficient removal of PE cannot be achieved by acid degumming+bleaching nor only bleaching process. Same observations were obtained with different types of AF feedstock containing high PE content (Table II.). Furthermore, filterability properties of water degummed oil are better in comparison to as oil as received and thus process pre-treatment capacity is also intensified by this process concept.

By utilization of this method, PE content in AF purchase specifications can be significantly increased. Process costs and production capacity will thus be enhanced as well.

TABLE I

Water degumming (W-C), Water degumming + filtration (W-C-F*) and Water degumming + bleaching (W-C-AT-W-A-F) of AF and their effect on PE removal

| | | | Feed | W-C | W-C-F* | W-C-AT-W-A-F 1 wt-% |
|---|---|---|---|---|---|---|
| ASTMC4629 | N | mg/kg | 740 | 720 | 710 | 540 |
| ISO 6656 | PE | Wt-ppm | 252 | 22 | <10 | 12 |
| ASTMD5185 | Si | mg/kg | 1.4 | 0.3 | <0.3 | 0.3 |
| ASTMD5185 | Al | mg/kg | <0.3 | <0.3 | <0.3 | 0.45 |
| ASTMD5185 | Fe | mg/kg | 1.9 | 1.5 | 1.4 | 0.13 |
| ASTMD5185 | Na | mg/kg | 25 | 5 | 5 | <1.0 |
| ASTMD5185 | Ca | mg/kg | 30 | 13 | 13 | <0.3 |
| ASTMD5185 | Mg | mg/kg | 3.7 | 2.1 | 2 | <0.3 |
| ASTMD5185 | P | mg/kg | 57 | 29 | 28 | 4.9 |

TABLE II

Water degumming (W-C), Water degumming + bleaching (W-C-AT-W-A-F) and Bleaching (AT-W-A-F) of AF and their effect on PE removal

| | | | Feed | W-C | W-C-AT-W-A-F | AT-W-A-F |
|---|---|---|---|---|---|---|
| ASTMC4629 | N | mg/kg | 330 | 270 | 210 | 228 |
| ISO 6656 | PE | Wt-ppm | 332 | 101 | 70 | 273 |
| ASTMD5185 | Si | mg/kg | 1.4 | 1.2 | 0.99 | 1.5 |
| ASTMD5185 | Al | mg/kg | <0.3 | <0.3 | <0.3 | 1.5 |
| ASTMD5185 | Fe | mg/kg | 2 | 1.4 | <0.1 | 0.47 |
| ASTMD5185 | Na | mg/kg | 61 | 11 | <1.0 | 2 |
| ASTMD5185 | Ca | mg/kg | 11 | 7.9 | <0.3 | 0.74 |
| ASTMD5185 | Mg | mg/kg | 1.8 | 1.2 | <0.3 | 1.2 |
| ASTMD5185 | P | mg/kg | 81 | 27 | 4.4 | 14 |

The invention claimed is:

1. A process for removal of plastics from a lipid material, the process comprising:

a) heating the lipid material;

b) adding water to the lipid material, wherein an amount of added water is 0.1 to 5% (wt %) wherein the added water does not contain an acid;

c) allowing efficient contact of water and lipids to enable impurities to transfer to water phase;

d) separating the lipid material from step c) by centrifugation, settling, decanting or evaporating; and e) subjecting the separated lipid material from step d) to a filtration step to remove solid impurities; and f) optionally subjecting the lipid material from step d) or filtrate from step e) to a post treatment to thereby remove plastics in the lipid material.

2. The process according to claim 1, wherein the lipid material is selected from fats or oils of animal origin selected from fish based oils or fats, suet, tallow, blubber, recycled alimentary fats, or a lipid material/oil of plant, microbial selected from one or more of tall oil or the residual bottom fraction from tall oil distillation processes, vegetable or plant based oil or fat selected from sludge palm oil or used cooking oil, microbial or algae oils, free fatty acids, oils originating from yeast or mould products, oils originating from biomass, rapeseed oil, canola oil, colza oil, tall oil, sunflower oil, soybean oil, hemp oil, olive oil, linseed oil, cottonseed oil, mustard oil, palm oil, arachis oil, castor oil, coconut oil, starting materials produced by genetic engineering, and biological starting materials produced by microbes selected from algae and bacteria or any mixtures of said feedstocks, or a lipid material used in the process may also be fossil based, selected industrial from various oils.

3. The process according to claim 1, wherein the lipid material is of any type of animal origin selected from fats or oils or any mixtures thereof and selected from fish based oils or fats, suet, tallow, blubber, or recycled alimentary fats.

4. The process according to claim 1, comprising:

heating the lipid material a temperature selected to be of about 40° C., about 170° C. to about 40° C. to about 200° C., about 40° C. to about 120° C., about 50° C. to about 110° C., about 60° C., about 100° C., about 40° C., about 50° C., about 60° C., about 70° C., about 80° C., about 90° C., about 100° C., about 110° C. or about 120° C.

5. The process according to claim 1, comprising:

performing step c) by vigorous mixing, slow mixing, counter current flow, dynamic cavitation or acoustic irradiation.

6. The process according to claim 1, wherein the process does not include a bleaching step.

7. The process according to claim 1, comprising:

selecting the plastics from polyethylene, Bakelite, polystyrene, polyvinyl chloride, poly(methyl methacrylate), rubber or synthetic rubber, polyester, polyethylene terephthalate, high-density polyethylene, polyvinylidene chloride, low-density polyethylene, polypropylene, high impact polystyrene, polyamides, acrylonitrile butadiene styrene, polyethylene/acrylonitrile butadiene styrene, polycarbonate, polycarbonate/acrylonitrile butadiene styrene, polyeurethanes, or any mixtures thereof.

8. The process according to claim 1, wherein the polymer is polyethylene.

9. The process according to claim 1, comprising:

removing up to 100%, original content of polyethylene in the lipid material, or removing at least about 20%, or at least about 30%, at least about 40%, at least about 50%, at least about 60%, at least about 70%, at least about 80%, at least about 90%, at least about 95%, at least about 98%, at least about 99% of polyethylene.

10. The process according to claim 2, wherein the lipid material is of any type of animal origin selected from fats or oils or any mixtures thereof and selected from fish based oils or fats, suet, tallow, blubber, or recycled alimentary fats.

11. The process according to claim 10, comprising:

heating the lipid material a temperature selected to be of about 40° C., about 170° C. to about 40° C. to about 200° C., about 40° C. to about 120° C., about 50° C. to about 110° C., about 60° C., about 100° C., about 40° C., about 50° C., about 60° C., about 70° C., about 80° C., about 90° C., about 100° C., about 110° C. or about 120° C.

12. The process according to claim 11, comprising:

performing step c) by vigorous mixing, slow mixing, counter current flow, dynamic cavitation or acoustic irradiation.

13. The process according to claim 12, wherein the process does not include a bleaching step.

14. The process according to claim 13, comprising:

selecting the plastics from polyethylene, Bakelite, polystyrene, polyvinyl chloride, poly(methyl methacrylate), rubber or synthetic rubber, polyester, polyethylene terephthalate, high-density polyethylene, polyvinylidene chloride, low-density polyethylene, polypropylene, high impact polystyrene, polyamides, acrylonitrile butadiene styrene, polyethylene/acrylonitrile butadiene styrene, polycarbonate, polycarbonate/acrylonitrile butadiene styrene, polyeurethanes, or any mixtures thereof.

15. The process according to claim 14 wherein the polymer is polyethylene.

16. The process according to claim 15, comprising:

removing up to 100%, original content of polyethylene in the lipid material, or removing at least about 20%, or at least about 30%, at least about 40%, at least about 50%, at least about 60%, at least about 70%, at least about 80%, at least about 90%, at least about 95%, at least about 98%, at least about 99% of polyethylene.

* * * * *